United States Patent [19]

George

[11] 4,398,712

[45] Aug. 16, 1983

[54] SHEET SORTERS

[75] Inventor: Clifford L. George, Macedon, N.Y.

[73] Assignee: Xerox Corporation, Stamford, Conn.

[21] Appl. No.: 268,548

[22] Filed: May 29, 1981

[51] Int. Cl.[3] ..... B65H 39/105; B65H 39/11

[52] U.S. Cl. ..... 271/293; 271/294; 271/295

[58] Field of Search ..... 271/293, 294, 295, 292, 271/289, 287; 270/58

[56] References Cited

U.S. PATENT DOCUMENTS

| | | | |
|---|---|---|---|
| 3,414,254 | 12/1968 | Snellman et al. | 271/296 |
| 3,721,435 | 3/1973 | Zanders | 271/293 |
| 3,788,640 | 1/1974 | Stemmle | 271/293 |
| 3,851,872 | 12/1974 | Gerbasi | 271/291 |
| 3,944,207 | 3/1976 | Bains | 271/297 X |
| 3,957,264 | 5/1976 | Bach et al. | 271/287 |
| 3,977,667 | 8/1976 | Cross et al. | 271/289 |
| 4,015,841 | 4/1977 | Mitsumasu | 271/297 |
| 4,055,339 | 10/1977 | Looney | 271/293 |
| 4,073,118 | 2/1978 | Weber et al. | 271/279 X |
| 4,131,041 | 12/1978 | Ludemann et al. | 271/294 X |
| 4,203,587 | 5/1980 | Kishi et al. | 271/293 |

FOREIGN PATENT DOCUMENTS

| | | | |
|---|---|---|---|
| 54-12921 | 1/1979 | Japan | 271/293 |

OTHER PUBLICATIONS

Xerox Disclosure Journal, vol. 1, No. 4, Apr. 1976, p. 59.

Japanese Published Application No. 53-79545 Jul. 14, 1978 (Abstract & Drawing).

*Primary Examiner*—Bruce H. Stoner, Jr.

[57] ABSTRACT

A sheet sorter which has a plurality of sheet receiving bins which comprises an array of movable plates such that adjacent plates define an individual bin, is provided with a quadrant plate for indexing the input ends of the bin plates past a fixed feed throat to align the bin opening in line with the feed throat for sheet insertion. Adjacent bin plates are interconnected to limit their maximum spacing apart, and are movable apart and together for varying the size of the bin openings. The bin plates are spaced apart opposite and at one side of the feed throat and are spaced together when indexed past the feed throat to the other side of the feed throat. Preferably the bin plates are arrayed in a vertically oriented fan-like array and the quadrant plate is rotatable about an axis.

12 Claims, 5 Drawing Figures

10
11
13
14
15
16
17
18
19
20
21
22
23
24
25
26
27
27a
28
32
33
34
34a
35
57
5a
1
2
3
4
5
A
B
C
D
E
F
T
B1
B2
B3
B4
B5

SHEET SORTERS

BACKGROUND OF THE INVENTION

This invention relates to sheet sorters for collating sheets into sets and is particularly but not exclusively concerned with sorters suitable for use with or as part of an office reproduction machine.

Frequently, it is highly desirable to reproduce a plurality of copies of the same original document or information. Moreover, if several original documents are reproduced, it is desirable to produce a plurality of collated sets of copies. This may be achieved by the utilization of a sorter. Generally the sorter comprises a plurality of bins wherein each bin is designed to collect one set of copies of the original document.

PRIOR ART

A variety of sorters are known in the art. Most sorters used commercially with photocopiers comprise a plurality of tray members which are spaced apart and extend in an array, which may be horizontal as for example in U.S. Pat. Nos. 3,944,207 and 4,015,841 or vertical as in U.S. Pat. No. 3,977,667. Such sorters take various well known forms. There are travelling gate sorters as described for example in U.S. Pat. No. 3,414,254 in which sheets are conveyed by a sheet transport past the opening of a vertical array of bins and a movable gate or feed throat traverses across the bin openings for deflecting the sheet into the respective bins in turn. Another type has fixed bins and a deflector or gate associated with each bin; a sheet transport advances the copy sheets past the bin openings and the deflectors are actuated in turn to guide the sheets from the transport into the respective bins. Finally, in moving bin sorters such as described in U.S. Pat. Nos. 3,788,640 and 4,055,339, the bins themselves are indexed past a fixed feed throat. Within such class of sorters may be included rotary sorters having bins extending radially outwardly from an axis or rotation, as shown for example in U.S. Pat. No. 3,851,872. It is also known from U.S. Pat. No. 4,073,118 to have a fan-like array of bins indexed past a fixed feed throat.

For maximum compactness for a given capacity, the bins should preferably be completely filled. However, the capacity of the bins is limited by the space required over the stack for insertion of the final sheet. To alleviate this difficulty it is known from various of the above mentioned patents that the bin entrance openings of the respective bins may be selectively increased in size by relatively moving the bin plates defining the opening as a sheet is fed into it.

This invention is concerned with sorters of the moving bin type and in particular with a sorter such as shown in Xerox Disclosure Journal Vol. 1, No. 4, April 1976, Page 59 which comprises a plurality of sheet-receiving bins defined by an array of movable plates and means for indexing the input ends of the bin plates sequentialy past a fixed feed throat to align the bin openings in turn with the feed throat, adjacent said bin plates being relatively movable apart and together for varying the sizes of the bin openings. No indexing means is described in that disclosure. Such a sorter is also disclosed in Japanese Published Application No. 53-79545 where a unidirectional indexing system includes a Geneva wheel which allows the bins to fall past the feed throat one at a time.

SUMMARY OF THE INVENTION

In accordance with an aspect of the present invention a sheet sorter with a plurality of sheet receiving bins and means to index the bins past a fixed feed throat is provided. In particular, the plurality of sheet receiving bins comprises an array of movable plates which are interconnected at their sheet input end to limit their maximum spacing apart and which are spaced apart opposite and at one side of the feed throat and are spaced together when indexed past the feed throat to the other side of the feed throat. In a specific embodiment, the indexing means comprises a quadrant plate rotatable about an axis having the end of the movable bin plates opposite said input ends attached to it such that the bin plates which are vertically oriented are arranged in a fan-like array. In this orientation sheets are successively introduced to the individual bins and fall by gravity to the bottom of the bin. In any particular sorting cycle, the bins awaiting sheet insertion including the bins opposite the feed throat are spaced apart and once the sheet has been inserted, the fan-like array is indexed to the loaded spaced together orientation.

From another aspect the invention is characterized in that said indexing means is adapted to sequentially transfer the plates in turn from one side to the other of the feed throat, the bin plates being interconnected to limit their maximum spacing to permit engagement of the bin plates by the indexing means.

By spacing the bin plates apart at one side of the feed throat insertion of the individual sheets in a set and removal of sheet sets from the bins is facilitated.

Accordingly it is an object of the present invention to provide an improved sheet sorter.

It is an additional object of the present invention to provide a simple lightweight compact sheet sorter.

It is an additional object of the present invention to provide a sheet sorter which facilitates easy sheet insertion into the sorting bins.

It is an additional object of the present invention to provide a sheet sorter which facilitates easy sorted sheet set extraction from the sorting bins.

It is a further object of the present invention to provide a sheet sorter which inverts and stacks copy sheets.

It is an additional object of the present invention to provide a simple means to index individual bins past a stationary sheet feed throat.

BRIEF DESCRIPTION OF THE DRAWINGS

For a better understanding of the invention as well as other object and further features thereof, reference is had to the following drawings and description.

DESCRIPTION OF PREFERRED EMBODIMENT

Figure 1:
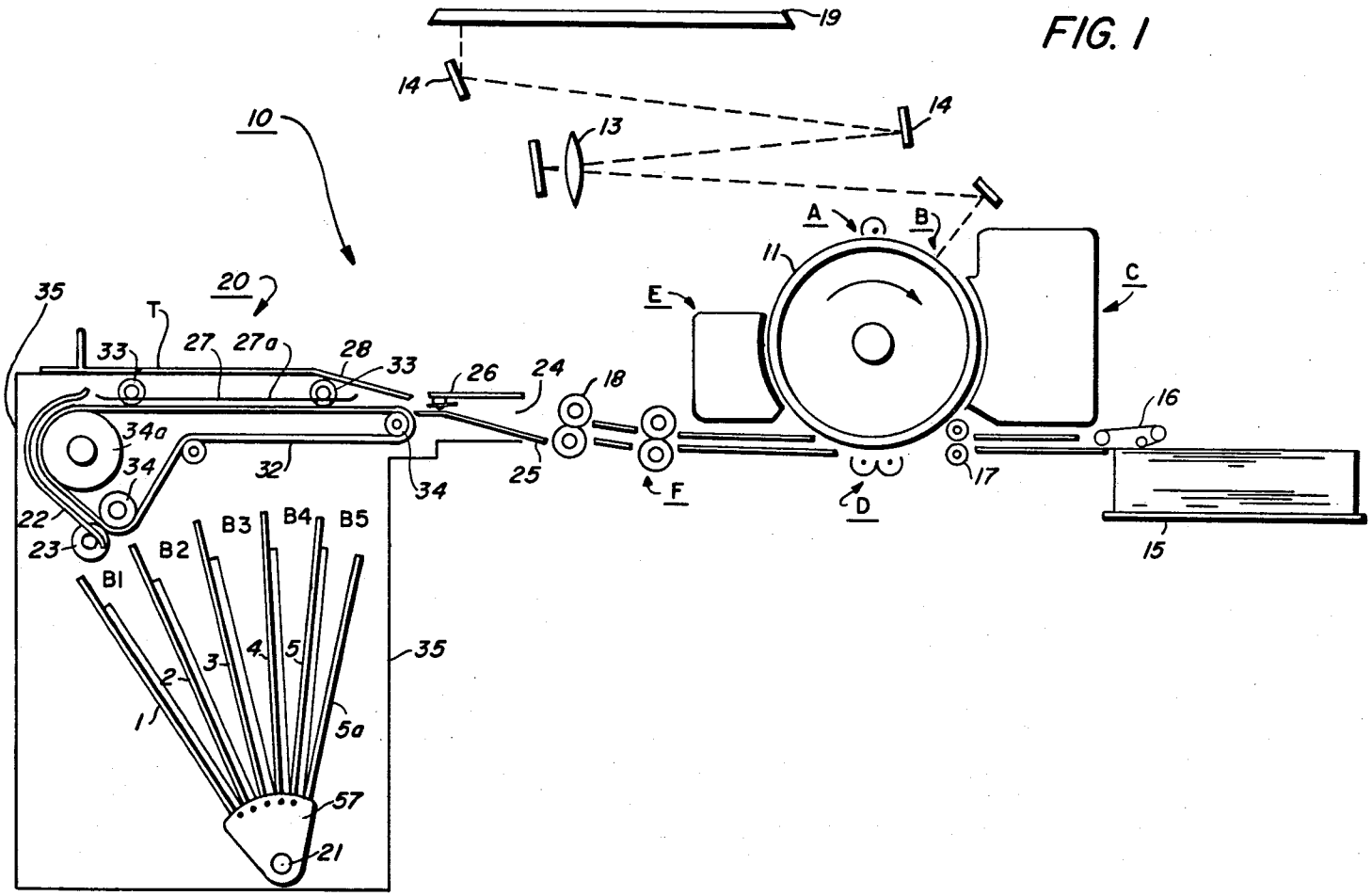
FIG. 1 is a schematic side elevation of a xerographic copier having a preferred embodiment of the sheet sorter according to the present invention.

Referring to FIG. 1, there is shown an automatic xerographic reproducing machine 10 having attached thereto a sheet sorter 20 according to this invention for collecting copy sheets produced in machine 10. Although the present invention is particularly well suited for use in automatic xerography, the apparatus 20 is equally well adapted for use with any number of devices in which cut sheets of material are delivered serially for collating into sets.

The processor 10 includes a photosensitive drum 11 which is rotated in the direction indicated by the arrow so as to pass sequentially through a series of xerographic processing stations; a charging station A, an imaging station B, a developer station C, a transfer station D, and a cleaning station E.

A document to be reproduced is placed on a platen 19 and scanned by means of a moving optical system including a lens 13 and mirror 14 to produce a flowing light image on the drum surface at B, the drum surface having been charged at A. Then the image is developed at C to form a visible toner image. Cut sheets of paper are moved into transfer station D from an elevating delivery tray 15 by means of a sheet feeder 16 via sheet registering apparatus 17 in synchronous relation with the image on the drum surface. Following transfer, the copy sheet is stripped from the drum surface and directed to a fusing station F. The drum surface itself continues past the cleaning station E at which residual toner remaining on the drum surface is removed prior to the drum surface again being charged at A. Upon leaving the fuser, the fixed copy sheet is passed to the processor output rolls 18 which are immediately next to or may form the input to the sorter 20. As will be apparent from the study of FIG. 1, the copy sheets are conveyed to the sorter 20 face-up.

Referring to FIGS. 1 to 4, the sorter 20 comprises five sheet-receiving bins B1–B5. The bins are defined by an array of movable plates 1–5 which respectively support sheets delivered to the bins and a cover plate 5*a* next to the bin 5. Movable bin plates 1–5 are pivotally mounted to the top of quadrant plate 57 which in turn is pivotally mounted for rotation about a fixed axis 21 for indexing the input ends of the bin plates 1–5 sequentially past a fixed or stationary feed throat 22 which may consist of the nip formed between nip roller 23 and transport belt 32 or alternatively a pair of driven nip rollers, through which sheets are serially delivered from the processor 10 to align the bin openings in turn with the feed throat. Indexing of the bin plates is achieved by indexing the quadrant plate 57 which is fixed to cover plate 5*a* as described in detail below. The bin plates themselves are relatively movable apart and together for varying the sizes of the bin openings.

Figure 2:
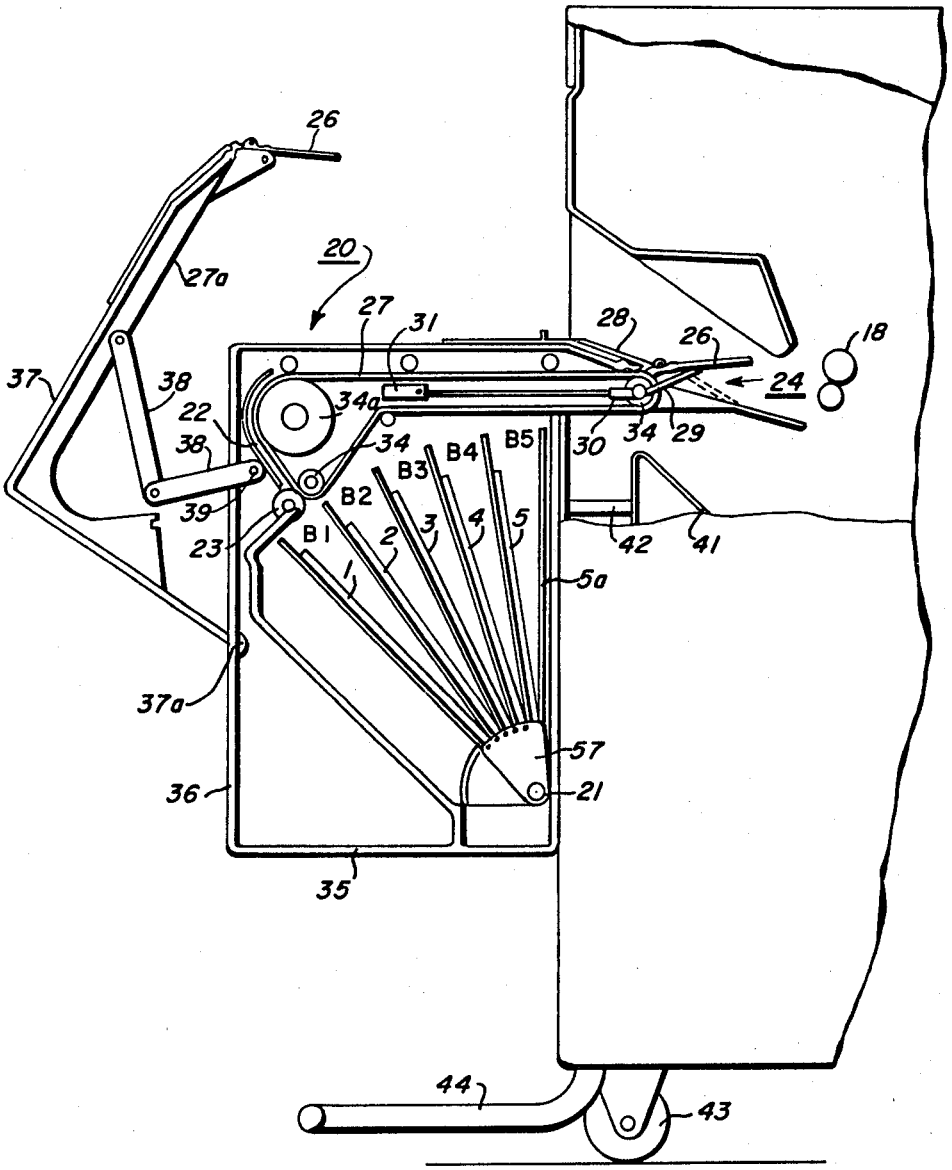
FIG. 2 is an enlarged view like that of FIG. 1 showing the sorter and its relationship to the copier in greater detail.

As shown in FIGS. 1 and 2, the sorter 20 is mounted on the output side of the processor 10 with its input 24 opposite the processor rolls 18. The input 24 of the sorter comprises a fixed lower guide plate 25 and a pivotally mounted upper diverter baffle 26 which may be moved between a raised position as shown in full lines in FIGS. 1 and 2 in which sheets are directed along path 27 to fixed feed throat 22 and a lowered position as shown in dotted lines in FIG. 2 in which sheets are directed across surface 28 to casual tray T formed by the top of the sorter. The casual output or non-sort tray T collects copies when they do not need to be sorted or the sorter is inoperative or can be used as an overflow when the sorter is full.

As shown in FIG. 2, the movable diverter plate 26 is shifted between its raised and lowered limit positions by a pivotally mounted lever 29 which is actuated through a rod 30 by a solenoid 31. The lever is biased by a spring to its raised position and activation of the solenoid 31 lowers the lever. This arrangement enables the diverter plate 26 to be separated from its drive for jam access as explained below.

The bin array is arranged generally vertically and the path 27 includes a generally horizontal portion extending from input 24 across the top of the sorter and a downwardly inclined portion for directing sheets downwardly into the bins. Path 27 is defined by upper and lower baffle plates of which only the upper plate 27*a* is visible in the drawings. Sheets are conveyed along the path 27 by a central, narrow drive belt 32 e.g., 3.5 cm wide, set into the lower guide baffle and having co-operating reaction rolls 33 along the horizontal portion of the guide path. The belt is entrained over guide rollers 34 arranged to conform the belt to the path 27, including a large roller 34*a* which provides a smooth transition between the horizontal and inclined portions of the path.

By arranging the bins B in a generally vertical or upright array and collecting the sheets on the faces of the bin plates facing the processor, it will be seen that the sheets are supported in the bins face down so that sheets fed to the individual bins in the order 1-N are arranged in that sequence in the bins.

As shown in FIG. 2 the paper path 27 may be divided to provide access thereto particularly for clearing jammed sheets. To this end a portion of the cover 35 including the top and a section of the end wall 36 form an L-shaped door 37 carrying the upper baffle 27*a* and diverter 26, which can be hinged to an open position as shown in FIG. 2 about pivot 37*a*. Folding links 38 are pivotally supported between the door 37 and a fixed mounting 39 on the sorter frame to limit the degree to which the door opens and prevent it from falling completely open. An interlock switch 40 (See FIG. 3) switches off the sorter when the door 37 is opened.

The sorter is mounted on the processor 10 with its input 24 extending into an opening in the processor side wall opposite the output rolls 18. With this arrangement and by providing the diverter baffle 26 on the door 37, access to the paper path may be obtained right back to the processor output rolls 18.

As shown in FIG. 2, the sorter 20 hangs on the end of the processor, being connected to the frame 41 of the processor by spacer bolts 42. The processor itself is mounted on four castors 43 one of which is visible in FIG. 2 and in order to prevent the assembly from tipping over during transport or in the event of an excessive downward force being applied to the sorter, a foot 44 projects from the processor beneath the sorter.

Figure 3:
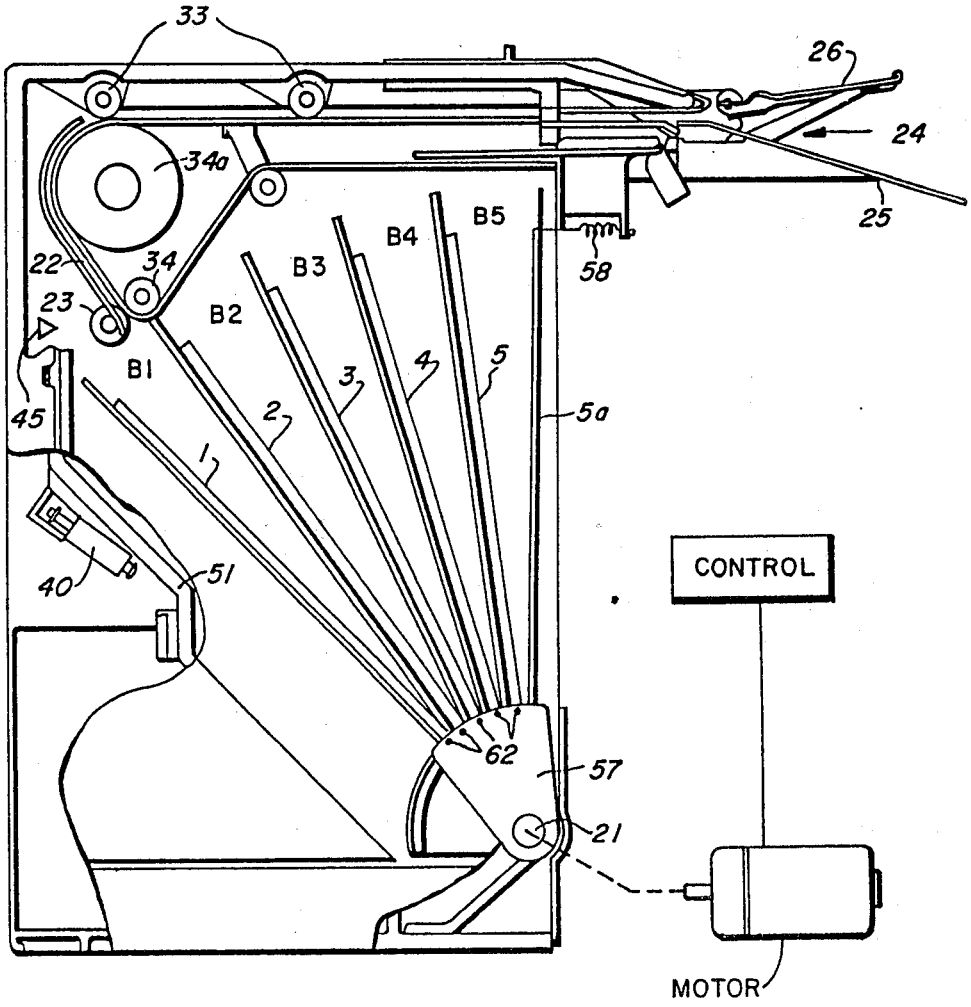
FIG. 3 is a further enlarged view like that of FIG. 1 of the sorter showing more detail.
Figure 4:
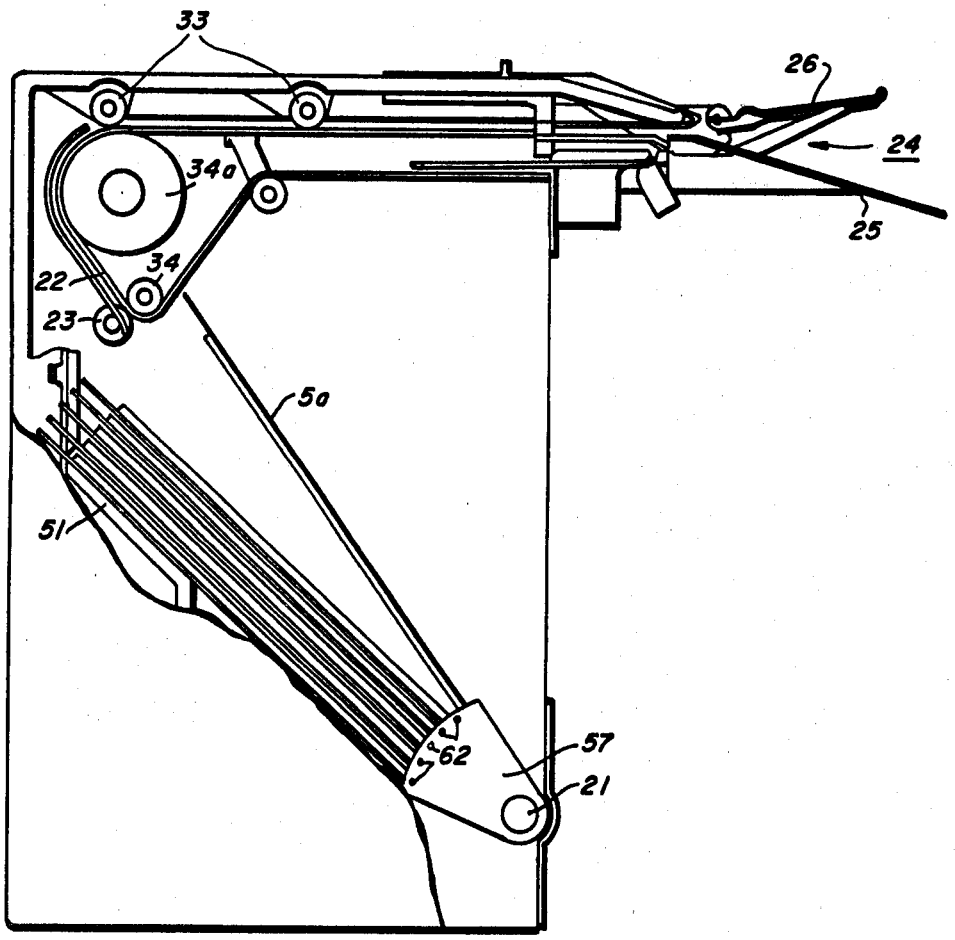
FIG. 4 is a view like that of FIG. 3 showing a different operative condition of the sorter.

The bins B are indexable by the quadrant plate 57 between the position shown in FIG. 3 in which bin B1 is opposite the feed throat 22 and all the bins are enlarged to a maximum spacing and a position as shown in FIG. 4 in which the bin B5 is enlarged and opposite the feed throat and the bins B1–B4 are collapsed. With this arrangement the bins may all be enlarged as shown in FIG. 3 to facilitate individual sheet insertion and removal of sheet sets from the bins without destroying their integrity while a space-saving producing compact sorter arrangement is achieved by collapsing the bins at the other side of the feed throat as shown in FIG. 4. In accordance with a preferred feature of the invention the spacing apart of the bin plates opposite the feed throat and at one side thereof is achieved by biasing the cover plate 5*a* towards the side of the sorter and interconnecting the bins so as to limit their maximum spacing. This is achieved by means of spring 58 attached to the cover plate 5a and the side of the sorter frame. Thus it will be seen with reference to FIGS. 3 and 5 that the bin array is biased in a clockwise direction to the right by the spring 58.

Figure 5:
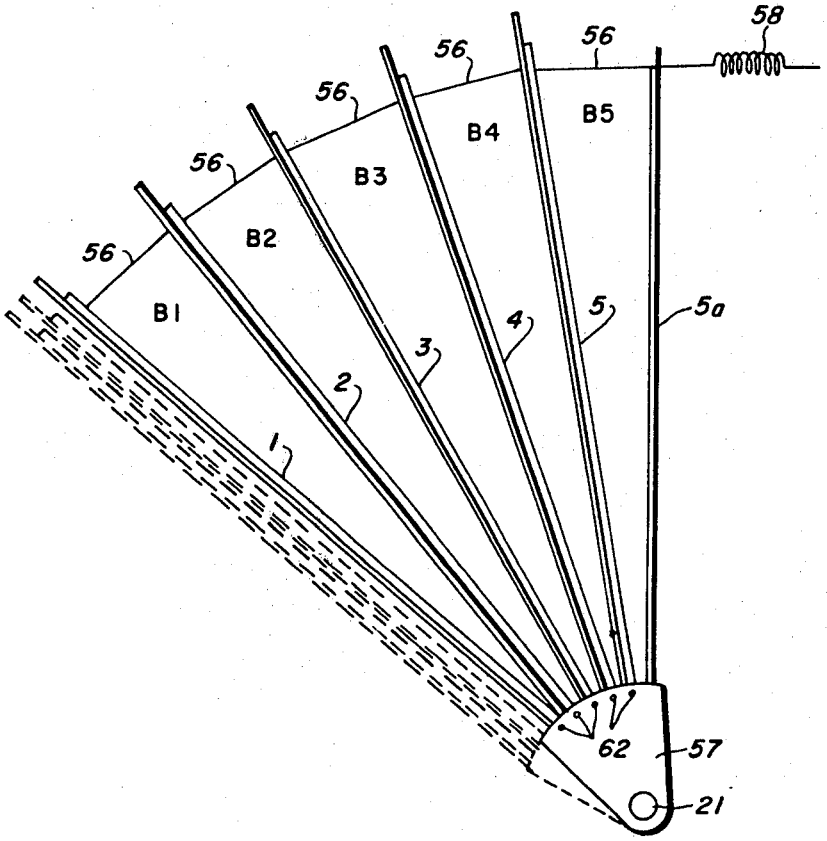
FIG. 5 is a schematic side elevation of the bin array illustrating the bin spacing.

In order to limit the maximum spacing of the bin plates, the bin plates are connected in the following manner. The bin plates 1–5 and 5a are carried by the quadrant plate 57 which is mounted for rotation about the axis 21. The bin plates 1–5 are themselves pivotally mounted about pivot points 62 in the upper end of the quadrant plate 57 as shown in FIG. 5. Bin plate 5a is rigidly connected to the quadrant plate so that as the quadrant plate is indexed counterclockwise, it indexes with the quadrant plate whereas bin plates 1–5 are free to pivot about pivot points 62 and once past the feed throat, can be collapsed in accordian fashion.

The bins are interconnected at the sheet input end by wires 56 between adjacent bins. By selecting or adjusting the length of the wire between adjacent bins, the size of the bin opening can be adjusted. In the home position when the last bin plate 5a is in a roughly vertical orientation, the bin plates 1–5 pivot counterclockwise by gravity about pivot points 62 in quadrant plate 57. The force of gravity pulls the bin plates 1–5 down away from the fixed bin plate 5a. This gravitational force insures that the individual bin openings are maintained at their maximum spacing by the individual wires 56 between adjacent bin plates. If desired, the individual wire may be a single wire placed through holes in a corner of bin plates 1–5 with a knot or stop fixed to it adjacent each bin plate which won't go through the hole and thereby provides a stop for each bin plate. Typically the spacing between bins is selected and maintained by the bin wires such that when the bin plate 5a is in the home position in the generally vertical orientation bin B1 is opposite the feed throat 22. Following insertion of the sheet in bin B1 the fan-like array of bins may be indexed counterclockwise. As the bin plate falls counterclockwise by gravity past the feed throat it contacts a bin stop 51 (See FIG. 4) and comes to rest against it. On indexing successive plates past the feed throat they come to rest upon other bins. As shown in FIG. 4 the mounting arrangement of the bin plates allows them to collapse into a generally parallel arrangement which limits the minimum spacing of the bin plates and thereby the total volume occupied by the sorter.

The quadrant plate and the fixed bin plate 5a are indexed in stepwise fashion to the feed throat position such that successive bins B1–B5 come into feeding engagement with the feed throat. After a sheet has been inserted in the bin it is indexed further to the rest position. While the Figures illustrate a five bin sorter it must be understood that more or fewer bins may be used. When the last sheet to be sorted has been inserted in its respective bin, the array of bins can be indexed in a clockwise direction so that they return to the home position. With successive bins now separated by the force of gravity as discussed above, the sorted sheets may be readily removed manually by the operator.

The indexing mechanism may be controlled in any suitable manner. Typically the quadrant plate 57 is driven clockwise or counterclockwise by a bidirectional motor which can be activated by the main machine logic. In addition a switch in the feed path may control the indexing mechanism. For example, a sensor 45 in the feed throat could sense the trailing edge of a sheet being inserted in a bin and activate the quadrant plate drive motor to index the quadrant plate one space in the counterclockwise direction to the next bin. In addition to the sensor in the feed throat a sensor may be placed in the bin to detect the completed insertion of a sheet in the bin and thereby inactivate the quadrant plate drive motor from further indexing movement. Furthermore, the control system may be programmed such that after a pause of a stated duration in the sheet path without a sheet entering the feed throat the bin array automatically indexes or is driven back to the home position to enable emptying the individual bins of sorted sheets to prepare the bins for the next sorting cycle. The machine logic may also control the number of sets collated in accordance with the number of copies of each original produced by the processor by controlling the number of bins indexed past the feed throat during each sort cycle. The machine logic also controls the position of the baffle 26 depending whether sort or non-sort mode is selected.

The operation of the sorter will now be described. Firstly, in non-sort mode, the baffle 26 is arranged in its lowered position as shown in the dotted line position of FIG. 2 and sheets are delivered face-up to the tray T forming an uncollated stack. In sort mode, the solenoid 31 is actuated to raise the baffle 26 to guide sheets from the processor 10 into the path 27 where they are engaged by the feed belt 32 and carried out of the feed throat 22 into the bin opposite it. The belt 32 speed is greater than that of processor output rolls 18 to avoid the sheets buckling as they enter the sorter and, to provide a smooth change in speed as the sheet enters path 27. Foam rollers (not shown) are provided on the shaft carrying the input roller 34. At the start of sorting, the bins B are all open in the home position and arranged as shown in FIG. 3 and the first sheet is fed into bin B1 which is opposite the feed throat 22. As the first sheet leaves the feed throat and enters bin B1 the trailing edge is sensed and the quadrant plate drive motor is activated indexing the quadrant plate counterclockwise. As the sheet enters the bottom portion of bin B1 its leading edge is sensed which deactivates the quadrant plate drive motor such that the bin B2 is in position for sheet insertion. Alternatively the control system may be programmed such that after the quadrant plate drive motor is activated, it only runs for a period of time sufficient to advance the next bin plate into position so that the next copy sheet will enter bin B2. This process is continued until the last sheet is inserted in bin B5 after which the control system activates the quadrant plate drive motor and indexes the whole fan-like array clockwise back to the home position.

It should also be noted that if desired the control system may be programmed to provide bidirectional sorting. That is, once the bins have been filled with copies one through five of sheet number 1 in bins B1–B5, they can be sequentially rotated clockwise to insert copies one through five of sheet number 2 in bins B5–B1. When the sorting job is completed a pause of measured duration exists in the sheet path which is detected by the control system which in turn indexes the fan-like array back to the home position where the collated sets of sheets may be easily withdrawn from the sorting bins.

Although specific embodiments have been described above, it will be understood that various modifications may be made to the specific details referred to herein without departing from the scope of the invention as defined in the appended claims. For example, the sets in adjacent bins may be relatively offset, for example, by having offset inner end stops in every other bin.

I claim:

1. A sheet sorter comprising a plurality of sheet receiving bins, said plurality of sheet receiving bins comprising an array of movable plates such that adjacent plates define an individual bin, a quadrant plate for indexing the input ends of the bin plates past a fixed feed throat to align the bin opening in line with the feed throat for sheet insertion, said quadrant plate being rotatable about an axis, having the end of said movable bin plates opposite said input ends attached thereto defining a plurality of sheet receiving bins, and having the last bin plate firmly fixed to said quadrant plate with the other bin plates being movably connected to said quadrant plate;

adjacent bin plates being movable apart and together for varying the sizes of the bin openings, said bin plates being interconnected to limit their maximum spacing apart, said bin plates being spaced apart opposite and at one side of the feed throat and being spaced together when indexed past the feed throat to the other side of the feed throat.

2. The sheet sorter of claim 1 wherein said fixed feed throat and said array of movable bin plates is vertically oriented such that during sheet insertion the individual sheets fall by gravity from the feed throat into the individual bins.

3. The sheet sorter of claim 1 wherein the bin plates opposite the feed throat and at said one side of the feed throat are biased apart.

4. The sheet sorter of claim 1 wherein the indexing means is operable to index the bin plates past the feed throat in both directions.

5. The sheet sorter of claim 1 wherein the bin plates are arranged in a fan-like array.

6. The sheet sorter of claim 1 wherein said bin plates are interconnected by a wire between adjacent plates to limit their maximum space opening.

7. The sheet sorter of claim 6 wherein said bin plates are spaced apart opposite the feed throat and on the side of the feed throat awaiting copy sheet insertion and are spaced together on the side of the feed throat following copy sheet insertion and including a first bin plate stop to support said bin plates when indexed past the feed throat.

8. The sheet sorter of claim 7 wherein the first of said bin plates pivots about said quadrant plate and falls by gravity from the fixed vertical position of the last plate relative to the quadrant plate whereby the sheet entrance portion of said bin plates are spaced apart in the bin opposite the feed throat and the bins awaiting copy sheet insertion.

9. The sheet sorter of claim 7 further including means to sense the insertion of the leading edge of a sheet into the bin entrance and means responsive to said sensing means for indexing said quadrant plate so that the next bin plate falls past the feed throat thereby forming the next bin for copy sheet insertion.

10. The sheet sorter of claim 9 further including means to index the bin plates back to the home position for insertion of the next sheet being sorted into the individual bins.

11. The sheet sorter of claim 10 including a transport to deliver sheets from a sheet supply to the top of the feed throat.

12. The sheet sorter of claim 11 including deflector means in the transport to selectively guide a sheet to a collecting tray rather than to the sorter.

* * * * *